United States Patent [19]

Strauss

[11] 4,395,342

[45] Jul. 26, 1983

[54] GRANULAR FABRIC SOFTENING COMPOSITION

[75] Inventor: Daniel L. Strauss, Mason, Ohio

[73] Assignee: The Procter & Gamble Company, Cincinnati, Ohio

[21] Appl. No.: 265,757

[22] Filed: May 21, 1981

Related U.S. Application Data

[63] Continuation-in-part of Ser. No. 156,995, Jun. 6, 1980, abandoned.

[51] Int. Cl.[3] ..... D06M 13/46

[52] U.S. Cl. ..... 252/8.75; 252/8.8

[58] Field of Search ..... 252/8.8

[56] References Cited

U.S. PATENT DOCUMENTS

| | | | |
|---|---|---|---|
| 2,295,504 | 9/1942 | Shelton | 424/329 |
| 3,325,404 | 6/1967 | Cohen et al. | 252/8.75 |
| 3,329,609 | 7/1967 | Blomfield | 252/8.8 |
| 3,349,033 | 10/1967 | Zuccarelli | 252/8.75 |
| 3,356,526 | 12/1967 | Waldman et al. | 117/100 |
| 3,573,091 | 3/1971 | Waldman et al. | 117/100 |
| 3,892,669 | 7/1975 | Rapisarda et al. | 252/8.75 |
| 3,904,533 | 9/1975 | Neiditch et al. | 252/8.8 |
| 3,954,630 | 5/1976 | Ramachandran | 252/8.6 |
| 3,997,453 | 12/1976 | Wixon | 252/8.75 |
| 4,113,645 | 9/1978 | DeSimone | 252/187 |
| 4,152,272 | 5/1979 | Young | 252/8.8 |
| 4,237,155 | 12/1980 | Kardouche | 427/242 |
| 4,259,373 | 3/1981 | Demessemaekers et al. | 427/242 |
| 4,265,772 | 5/1981 | Jones | 252/8.6 |

*Primary Examiner*—P. E. Willis, Jr.

*Attorney, Agent, or Firm*—Richard C. Witte; Ronald L. Hemingway; Leonard Williamson

[57] ABSTRACT

A comelted, granular fabric softening composition which is water dispersible in the cold water rinse of a washing machine, comprising about 60% to about 85% of a di-(long chain) quaternary ammonium salt and about 15% to about 40% of a mono- (long chain) quaternary ammonium salt having from 10 to 14 carbon atoms in its single long chain. The fabric softening composition may also contain up to about 25% of optional ingredients. In one embodiment of the invention the fabric softening agent is adapted to be placed within a water-permeable envelope. The envelope can be inserted into a washing machine during a laundering operation to provide fabric softening benefits to the clothes being laundered.

11 Claims, No Drawings

GRANULAR FABRIC SOFTENING COMPOSITION

CROSS-REFERENCE TO RELATED APPLICATION

This application is a continuation-in-part of U.S. application, Ser. No. 156,995, filed June 6, 1980, now abandoned.

TECHNICAL FIELD

The present invention relates most generally to particulate solid fabric conditioning materials adapted for convenient application to fabrics during a laundering operation. More particularly, the invention relates to improvements in particulate solid fabric softening compositions which allow the latter agents to be more easily dispersed in a laundry rinsing liquor.

BACKGROUND ART

U.S. Pat. No. 4,259,373, Demessemaekers et al., issued Mar. 31, 1981, assigned to the owners of the present invention, discloses a method of conditioning fabrics in which a granular solid fabric conditioning material is enclosed in an envelope with a porous wall communicating between the granular composition and the water of a washing machine. This is sometimes a preferred delivery system for fabric softeners for reasons disclosed in that application.

However, some fabric softening compositions are not efficiently delivered to a laundry rinsing liquor using this and other delivery systems, for the reason that certain softening materials, particularly those in a solid, granular form, are not easily dispersed in the rinsing liquor. This problem is especially prominent when cold water is used in the washing machine rinse cycle during which softening is to take place. (The rinse cycle is the preferred stage at which the softener should be transferred to the fabrics.) Since the cost of energy has increased enormously in recent years, it is now very important to provide fabric conditioning compositions which will work well in a cold rinse. An improvement in the dispersibility of granular fabric softeners in cold water is required if the need to reduce the energy cost of laundering is to be met.

Several patents state or suggest that certain quaternary ammonium compounds which are very useful in the softening of fabrics are not easily dispersed in the rinse water of a washing machine. U.S. Pat. No. 3,356,526, issued to Waldman et al., on Dec. 5, 1967, and U.S. Pat. No. 3,573,091, issued to Waldman et al. on Mar. 30, 1971, each disclose the use of powdered carriers to render quaternary compounds water dispersible; the '526 reference teaches the practice of that invention using the chloride analog of ditallow dimethyl ammonium methyl sulfate. U.S. Pat. No. 3,892,669, issued to Rapisarda et al. on July 1, 1975, and U.S. Pat. No. 3,325,404, issued to Cohen et al. on June 13, 1967, each disclose solubilizing agents which may be combined with ditallow dimethyl ammonium methyl sulfate or other di-(short chain), di-(long chain) quaternary ammonium compounds in order to solubilize these compounds in aqueous liquid fabric softening compositions.

The following references disclose liquid fabric softening compositions which contain mixtures of softening ingredients relevant to the present invention: U.S. Pat. No. 3,349,033, issued to Zuccarelli on Oct. 24, 1967, discloses a liquid fabric softening composition which may contain 6% of a softening agent which may be, for example, ditallow dimethyl ammonium methyl sulfate and 2% of a microbiological control agent which may be, for example, dodecyl or hexadecyl trimethyl ammonium chloride. U.S. Pat. No. 3,904,533, issued to Neiditch et al. on Sept. 9, 1975, discloses a liquid fabric softener which may contain, for example, ditallow dimethyl ammonium methyl sulfate (or one of many other homologs thereof) in combination with myristyl trimethyl ammonium bromide (or one of many other homologs thereof) as a low temperature stabilizing agent. U.S. Pat. No. 3,329,609, issued to Blomfield on July 4, 1967, teaches a composition of 20% to 80% of a generic material which includes ditallow dimethyl ammonium methyl sulfate in its definition; 5% to 10% of a material which may be myristyl trimethyl ammonium bromide; and 80% to 20% of a salt of hydrofluorosilicic acid. In Col. 4 this reference indicates that a large quantity of inert filler material may be added to the composition, and further indicates that the composition may be blended together in the form of dry ingredients. The overall suggestion of this reference is that the composition is a solid material.

SUMMARY OF THE INVENTION

The invention is a comelted, solid, granular fabric softening composition which is freely dispersible in a washing machine cold water rinse, comprising about 60% to about 85% of a first compound having the formula:

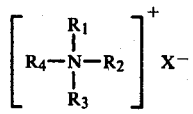

and about 15% to 40% of a second compound having the formula:

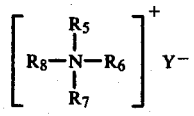

(Note: All percentages herein are percentage by weight unless otherwise indicated.)

In the above formulas, $R_1$, $R_2$, $R_5$, $R_6$ and $R_7$ are lower alkyl moieties, each preferably selected from a group comprising methyl, ethyl, and propyl moieties, each most preferably a methyl moiety. $R_3$ and $R_4$ are each higher alkyl or alkenyl moieties having from about 14 to about 22 carbon atoms, each preferably comprising tallow cuts, each more preferably comprising one or more aliphatic hydrocarbon moieties having from about 14 to about 18 carbon atoms, and each most preferably having from about 16 to about 18 carbon atoms. $R_8$ is an alkyl or alkenyl moiety having from about 10 to about 14 carbon atoms, preferably a coconut alkyl cut, in which dodecyl and myristyl moieties predominate, and most preferably a myristyl ($C_{14}$) moiety. X and Y are anions which are associated with the quaternary ammonium compounds of the present invention. As will be appreciated by those skilled in the art, X and Y may be any of a wide variety of anions which do not interfere with the utility of the composition. In a preferred mode of the present invention, either of X and Y may be selected from the following anions: chloride, bromide, iodide, fluoride, acetate, phosphate, nitrite, methyl sulfate, ethyl sulfate or nitrate. In a most preferred embodiment of the present invention, X is methyl sulfate and Y is bromide. Optional ingredients (as specified hereinafter) may also be present in the compositions of the present invention, but the resulting composition must be a granular solid. The advantage of this particular softening composition over those of the prior art is that it maximizes the use of the most effective softening agents, while providing for those agents improved dispersibility, particularly in cold water.

DESCRIPTION OF PREFERRED EMBODIMENTS

What follows is a description of the preferred embodiments of the present invention. It will be understood that the description herein of preferred embodiments or of particular species is presented to exemplify the invention, not to limit it. The scope of the invention is defined solely by the claims which are found at the end of this specification.

In order to explain certain terms used in this specification the following definitions are provided:

By a "fabric softening" agent or composition is meant an agent or composition which is substantive to textiles and which softens, lubricates, or reduces static accumulations on fabrics to which it is applied. Such a material typically has a melting point within the range of from about 20° C. to about 115° C., preferably within the range of from about 30° C. to about 68° C. The fabric softening agents of the present invention are the cationic quaternary ammonium compounds further described hereinafter.

As used herein, a comelted, solid, granular substance is said to be "water dispersible" if it is able to be dispersed throughout the water of the rinse cycle of a washing machine with no more mechanical agitation than is provided by the washing machine. In the context of a composition contained within a receptacle, water dispersibility is the degree to which the composition can escape from the receptacle during a normal washing machine rinse cycle, when the receptacle is in contact with the rinse water. Water dispersibility may either be measured directly by measuring the amount of material which is dispersed during a test cycle, or indirectly by measuring the degree to which fabrics subjected to the agent in question are softened (indicating the presence of a dispersed fabric softening agent in the laundry rinsing liquor).

The comelted, solid, granular composition of this invention is comelted and dried by flaking or spray drying using conventional techniques. It has been discovered that a comelted material is superior to dry mixed material. Therefore, it is important that the compositions of this invention are prepared by comelting.

The present invention is a fabric softening composition comprising from about 60% to about 85%, preferably from about 70% to about 80%, most preferably about 75% of a first compound having the formula:

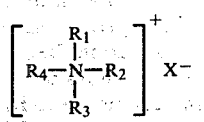

and from about 15% to about 40%, preferably from about 20% to about 30%, and most preferably about 25% of a second compound having the formula:

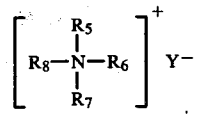

wherein the substituents for the above formulas are defined in the Summary of the Invention section above. In the description which follows, each of the individual components noted above, the mixture of these components to form a fabric conditioning active mixture, optional ingredients which round out a commercial composition, and finally the preferred mode of delivery will be more fully described.

Di-(Long Chain) Quaternary Ammonium Substituent

The first component of fabric softening compositions within the scope of the present invention is known hereinafter simply as a di- (long chain) quaternary ammonium component. The formula of this component is as follows:

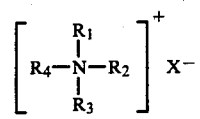

In the above formula each of $R_1$ and $R_2$ is a lower alkyl moiety. As used herein, "lower alkyl" is indicative of a substituent having 1, 2 or 3 carbon atoms. This will be understood to include substituents which include atoms other than hydrogen or carbon. For example, the lower alkyl substituent may be a hydroxy alkyl substituent. Other substituents which may be used within the definition of "lower alkyl" are methyl, ethyl and propyl moieties. Of these, methyl moieties are most preferred as $R_1$ and $R_2$ substituents.

In the above formula $R_3$ and $R_4$ are each alkyl moieties which may contain from about 14 to about 22 carbon atoms in an aliphatic configuration. In a preferred mode of practicing the present invention, the $R_3$ and $R_4$ moieties can be tallow cuts, which is to say that they can be the alkyl and alkenyl residues of tallow fatty acids. According to *The Merck Index*, 9th Edition, Entry 8820, the principal tallow fatty acids are oleic acid, palmitic acid, stearic acid, myristic acid and linoleic acid. Tallow also contains such minor constituents as cholesterol and arachidonic, elaidic and vaccenic acids. More preferred species for use herein are alkyl moieties having from about 14 to about 18 carbon atoms. The most preferred $R_3$ and $R_4$ moieties are alkyl moieties having from about 16 to about 18 carbon atoms, which are the predominant species found in tallow cuts.

X is an anion. As those skilled in the art are well aware, it frequently makes very little difference which anion from a wide selection is used in a given quaternary ammonium compound selected for use as a softener. Suffice it to say that this anion may be selected from any suitable anion known to the art, such as the chloride, bromide, fluoride, iodide, acetate, phosphate, nitrite, methyl sulfate, ethyl sulfate and nitrate anions (or their equivalents). In the di-(long chain) substituent, the most preferred anion is the methyl sulfate anion.

A number of examples of di-(long chain) quaternary ammonium compounds which may be used in the practice of the present invention are the following: ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyldiethyl ammonium chloride; dihexadecyl diethyl ammonium methyl sulfate; dihexadecyl dimethyl ammonium acetate; ditallow dipropyl ammonium phosphate; and ditallow dimethyl ammonium nitrate.

Mono-(Long Chain) Quaternary Ammonium Compounds

The second major component of the present novel fabric softening composition is a quaternary ammonium compound having the following formula:

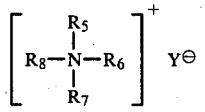

In this compound, $R_5$, $R_6$ and $R_7$ are lower alkyl moieties, as previously defined. $R_5$, $R_6$ and $R_7$ are independently selected, and preferably are selected from the group consisting of methyl, ethyl, and propyl moieties. Each of $R_5$, $R_6$ and $R_7$ is preferably a methyl moiety.

$R_8$ is the sole long chain substituent of the mono-(long chain) quaternary ammonium compounds defined herein. $R_8$ can most broadly be selected from the alkyl and alkenyl residues of one or more coconut fatty acids (or their chemical equivalents derived from other raw material sources), known hereinafter as "coconut cuts." While coconut cuts have chain lenghts of from about 8 to about 18 carbon atoms, the predominant species are those with a chain length of from about 12 to about 14 carbon atoms. The latter species are those which are believed to confer the benefit of the present invention. In a preferred mode of the invention, $R_8$ is selected from moieties having 10 to 14 carbon atoms, such as decyl, undecyl, dodecyl, tridecyl or tetradecyl moieties, or the unsaturated analogs of these alkyl radicals. The most preferred long chain substituent of this compound is a tetradecyl or myristyl moiety.

The anion Y found in the above formula may be any anion which is suitable for use in conjunction with a quaternary ammonium compound which is to be used as a fabric softening material. Specific anions which are useful herein are described above in connection with the description of the di-(long chain) quaternary ammonium compound.

Examples of complete mono-(long chain) quaternary ammonium compounds useful herein are as follows: coconut trimethyl ammonium bromide; myristyl trimethyl ammonium bromide; myristyl triethyl ammonium bromide; decyltrimethyl ammonium bromide; and dodecyl trimethylammonium bromide.

Complete Fabric Softening Formulations

It will be understood that a fabric softening composition in accordance with the present invention can be formulated from the di-(long chain) and mono-(long chain) components alone, in the proportions described above. However, certain optional ingredients can be added to the composition in order to accomplish a variety of objectives.

In a preferred embodiment of the invention, the fabric softening composition is in the form of a free-flowing powder. When necessary to facilitate the creation of such a powder, any of a wide variety of fillers can be added to the present composition. Such fillers are inorganic compounds such as sodium sulfate, calcium carbonate, aluminum oxide, and smectite clays or organic compounds such as high molecular weight polyethylene glycols. Smectite clays and aluminum oxide are preferred fillers for use herein. A description of smectite clays may be found in U.S. Pat. No. 3,862,058, issued on Jan. 21, 1975, to Nirschl et al., hereby incorporated herein by reference. The filler material, if present, may be present at a level ranging from 5% to 25% by weight of the fabric softening composition.

The fabric softening compositions described herein can also optionally contain minor proportions (i.e., 0.1% to about 15% by weight, in total) of various other ingredients which provide additional fabric conditioning benefits. Such optional ingredients include perfumes, bleaches, fumigants, bactericides, fungicides, optical brighteners and the like. Specific examples of typical solid, water soluble additives useful herein can be found in any edition of the publication, *Year Book of the American Association of Textile Chemists and Colorists.* Such additional components can be selected from those compounds which are known to be compatible with the fabric softening agents employed herein, or they can be coated with water soluble coatings such as solid soaps and the like, and they can thereby be rendered compatible with the fabric softening agents described herein. A preferred optional ingredient is a fabric substantive perfume having a melting point greater than 38° C., such as musk ambrette, musk ketone, musk xylol, ethyl vanillin, musk tibetine, coumarin, aurantiol, or mixtures thereof. There perfumes can be added directly to the fabric conditioning agent, or they may be encapsulated with a polyvinyl acetate and sodium alginate mixture. From about 0.1 % to about 5% by weight of a perfume is preferably added to the fabric softening composition.

Other optional ingredients useful herein are inorganic peroxide compounds such as alkali metal and ammonium perborates, percarbonates, monopersulfates and monoperphosphates. Solid, water soluble organic peroxides having the formula:

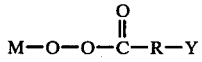

wherein R is a substituted or unsubstituted alkyl, alkylene or arylene group containing from 1 to about 14 carbon atoms, M is an alkali metal or hydrogen and Y is

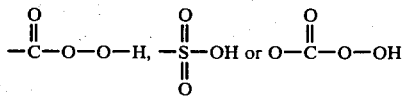

or any other group which yields an anionic group in aqueous solution are also useful herein. Many of these bleaches are more fully described in U.S. Pat. No. 3,749,673, issued July 31, 1973 to Jones et al., which is hereby incorporated herein by reference.

The water-soluble silicate compounds recognized in the art as corrosion inhibitors can be employed in the present composition at levels of up to about 5% by weight.

Release aids in the form of electrolytes (for example, $CaCl_2$) or nonionic surfactants can also be advantageously employed in the present invention.

Optional ingredients, generally, should be added after the comelted material of this invention is dried.

It will be recognized that any of the foregoing optional components can be provided in a solid, particulate form which can be dispensed onto fabrics concurrently with the fabric softening material to provide the desired additional fabric treatment benefits.

Preferred Mode of Delivery

As has already been described hereinabove, the fabric softening compositions of the present invention can be delivered to fabrics by placing a measured amount of the desired composition within a porous envelope which is inserted in a laundry washing machine during the rinse cycle of a laundering operation along with a load of clothes to be treated. A more particular description of dispensers suitable for this purpose follows.

The receptacle which releasably holds the fabric softening composition of the present invention is preferably a closed, flexible article having at least one porous wall comprising inner and outer layers. Inasmuch as the receptacle is to be used in an automatic clothes washer, it should be comprised of a water-insoluble material. Therefore, the receptacle herein can be made of any natural or manmade material meeting the above requirements. The porous wall can be made from woven, nonwoven, or foamed material.

In one preferred receptacle for use herein, the inner layer of the porous receptacle wall or walls is an elastic open cell foam. The open cell foams are distinquished from closed cell foams in that the closed cell structure consists essentially of isolated individual cells, while in the open cell structure a large proportion of adjacent cells communicate, forming an open matrix of material which allows the passage of fluids under certain conditions.

Open cell foams can be made from polystyrene, polyurethane, polyethylene, polyvinyl chloride, cellulose acetate, phenol-formaldehyde and other materials such as cellular rubber. Many of these materials and their method of manufacture are disclosed in standard references such as *Encyclopedia of Polymer Science and Technology,* Interscience Publishers, John Wylie & Sons, Inc. (1965), hereby incorporated herein by reference.

In another preferred embodiment, elastic nonwoven material may be used as the material for the inner layer of the porous receptacle wall. The preferred nonwoven materials used in the inner layer are bonded fibrous carded webs (if the fiber strength is suitable to allow carding) or fibrous batts in which the fibers are randomly distributed. The fibers or filaments can be natural materials such as wool, silk, jute, hemp, cotton, linen, sisal or ramie, or synthetic materials such as rayon, cellulose ester, polyvinyl derivatives, polyolefins, polyamides, or polyesters. Preferred materials include polyesters, polyamides, polyolefins, and polyvinyl derivatives and mixtures of these with rayon or cotton to achieve the desired elasticity.

Methods of making nonwoven materials are not a part of this invention and are not described in detail herein. Generally, however, such materials are made by air-or water-laying processes or by spin-bonding processes, any of which are well known to persons skilled in the art of making nonwoven webs.

The inner layer of the receptacle serves to preserve the shape of the receptacle, and to moderate the release of the fabric softening composition somewhat, although the rate of dispersion of the fabric conditioning compositions is controlled primarily by the outer layer of the article.

Especially preferred materials for use as the inner layer of the dispensing article are open pore polyurethane foams or spin-bonded nonwoven materials, especially those made from polyester. The polyurethane foam preferably has a density of from about 0.02 grams per cubic centimeter to about 0.04 grams per cubic centimeter, while the polyester nonwoven preferably has a density of from about 0.005 grams per cubic centimeter to about 0.02 grams per cubic centimeter. The thickness of this layer can vary depending on the release characteristics desired by the manufacturer, but will preferably be from about 0.2 centimeters to about 2.0 centimeters for polyurethane, and from about 0.2 centimeters to about 0.2 centimeters for polyester.

The outer layer of the preferred receptacle described herein is a moderately porous fabric. The fabric can be any of the above-described woven or nonwoven materials which meet the requirements set forth herein, but will generally be a nonwoven material made from polyester, polypropylene or mixtures of polyester with rayon or cotton. The outer layer generally has a lower porosity than the inner layer.

The receptacle described herein provides controlled release of the fabric conditioning composition during the rinse cycle of an automatic washing machine. The double layers of the receptacle provide more efficient release than a single layer receptacle, while also providing a more aesthetically pleasing consumer product, for the outer layer remains more free of stains and discolorations than does the inner layer.

In addition, the two-layered construction helps to insure that fabric staining is minimized by preventing a large amount of the fabric conditioning composition from being released at a single time.

When preparing the articles described herein the rate of release of the fabric softening composition from the receptacle is preferably optimized by selecting an appropriate receptacle for a particular fabric softening composition. The rate of release of the fabric softening composition depends on the porosity of the layered walls of the receptacle and on the physical characteristics of the fabric softening composition.

The receptacle can be provided in a variety of sizes and shapes, and the particular configuration of the receptacle is not critical to the practice of this invention. For example, the receptacle herein can be provided with a single wall or with a portion of one wall which exhibits the double-layered porous structure through which the fabric softening composition is dispensed. Preferably, the entire envelope of the receptacle will comprise double-layered porous material.

The fabric conditioning receptacle is prepared as follows. First, a pouch with one open end is prepared. This may be done by positioning sheets of the inner and outer layers of material one over the other (so that two inner layers are disposed between two outer layers), and than sealing a large portion of the perimeter of the pouch, as by forming a border of heat-sealed point bonds. The pouch is now ready to be filled with fabric softening material.

Second, an effective amount of the fabric softening composition is placed in the open pouch produced according to the first step above, between the two inner layers thereof. An "effective" amount of the fabric softening composition described herein is an amount sufficient to condition an average load of fabrics in an automatic washer. Of course, the actual amount of the fabric softening composition employed will depend on the fabric load and on the identity of the fabric softening composition selected for use in the receptacle. For an average 2 to 4 kilogram load of fabrics, roughly 4 to 12 grams of any of the foregoing fabric softening compositions provide good fabric softening results.

After the fabric softening composition is added to the pouch through the open portion of the pouch, the balance of the pouch perimeter is sealed, as with a pattern of heat sealed point bonds, in order to complete the receptacle.

Using the Fabric Softening Articles

The articles of the present invention can be utilized in a variety of ways depending on the desires of the consumer. In one process, an article prepared as described herein is placed in a washing machine with a load of fabrics at the start of the rinse cycle and left with the fabrics during the rinse and spin drying cycles of the washing machine. The rinsing water can be supplied at any temperature desired by the user, but generally is selected to have a temperature of from about 4° C. to about 60° C. The spent fabric softening article can be removed and discarded when the washing machine completes its cycle and stops. Alternatively, the pouch can be left with the load through the drying cycle, after which it is easier to find and to separate from the laundered fabrics. The dryer is operated in standard fashion to dry the fabrics, usually at a temperature of from about 50° C. to about 80° C. for a period of from about 10 to about 60 minutes, depending on the fabric load and type. The performance delivered by the receptacles described herein when used as described above is essentially equivalent to that of rinse-added liquid softeners in terms of softness.

The invention will further be illustrated by the following examples:

EXAMPLES 1-6

These examples demonstrate that the addition of a mono-(long chain) quaternary ammonium compound to a di-(long chain) quaternary ammonium compound in a granular composition increases the water-dispersibility of the latter compound.

The mono-(long chain) quaternary ammonium compound selected for use herein was myristyl trimethyl ammonium bromide (MTMAB). The di-(long chain) quaternary ammonium fabric softener selected for use herein was ditallow dimethyl ammonium methylsulfate (DTDMAMS). These materials were mixed together, in the proportions noted in Table I below, by comelting and stirring them. Each proportion of DTDMAMS was heated over a steam bath or a water bath until molten, then the MTMAB (Mytab) was added while stirring. Then 5% to 10% of 95% ethanol was added to reduce the viscosity of the comelt to facilitate pumping and spray drying. The comelted mixed softeners were then each sprayed through a fine nozzle to form droplets which solidified to form, in aggregate, a granular composition.

Next, double-walled pouches were constructed. The pouch outer walls were made of Sontara nonwoven polyester fabric having a basis weight of 20 grams per square yard (24 grams per square meter), available from E. I. du Pont de Nemours and Company, Inc. The pouch inner walls were made of Bondaire Fiberfill nonwoven polyester material, available from J. P. Stevens Company. 7 centimeter by 6 centimeter pieces of the respective materials were stacked so that the bottom and top pieces of the stack were the material intended to form the pouch outer walls, and so that the two central pieces in the stack were the material intended to form the inside walls of the pouches. The stacks were each secured to form an openmouthed pouch by heat-sealing the stacks together around three sides of their perimeter.

6.0 grams of each of the compositions to be tested were placed in one of the open-mouthed pouches between the facing inner layers thereof, and the pouches were stapled across their open mouths to complete their construction.

Each pouch was placed in a washing machine containing a load of laundry at the beginning of the washing machine rinse cycle. The temperature of the entering rinse water was about 50° F. (10° C.). After the washing machine had ceased to operate the pouch was removed and extracted with a 50:50 mixture of methanol and chloroform. The solvent was removed from the extract and the weight of remaining residue was measured. (The extraction and measurement technique is described in the Appendix section below.) The difference between this final weight and the initial 6.0 gram charge was calculated in order to find the weight of material dispersed to the water in the washing machine. This weight of material dispersed was then compared to the weight of material initially placed in the pouch to determine what proportion of the initial pouch contents remained in the pouch as an insoluble residue. The results of this test are stated in Table I below as a percentage of residue for a composition containing stated proportions of the respective starting materials.

TABLE I

| Example | % DTDMAMS | % MTMAB | % Residue |
|---|---|---|---|
| 1 | 0 | 100 | 0-5 |
| 2 | 75 | 25 | 10 |
| 3 | 80 | 20 | 34 |
| 4 | 85 | 15 | 50 |
| 5 | 90 | 10 | 95 |
| 6 | 100 | 0 | 95 |

EXAMPLES 7-12

These examples are intended to compare the softening performance of various compositions when delivered to a load of laundry in the rinse cycle of a washing machine as described in connection with Examples 1-6 above.

Pouches were made as described above and each filled with six grams of one of the materials listed in Table II below. The pouches were then sealed to form completed articles.

Each pouch was placed in a washing machine with a standard load of laundry which included 4 test terry towels made of 86% cotton and 14% polyester. (The towels had previously been stripped with an organic solvent to remove any fabric finish or softener residue which might obscure the test results.) The pouches were added at the beginning of the washing machine rinse cycle. In separate groups of tests the respective rinse water temperatures were 50° F. (10° C.) and 90° F. (32° C.). The test terry towels were then paired with equivalent towels which had been washed with Downy (a water-dispersible liquid fabric softener produced and marketed by The Proctor & Gamble Company and its affiliated corporations) to form graded pairs of towels. Each graded pair was compared blind by a panel of three expert graders to determine the relative softness of the paired towels. The softness difference between the towels was reported on a scale of 0 to 4; 0 represented a grade of "no difference," 4 represented a grade of "a whole lot different," and intermediate grades represented more moderate degrees of difference. The softness grades were then statistically combined into a single result for each test. A positive softness grade in Table II below indicates performance which is better than that of Downy, while a negative softness grade indicates the opposite result.

TABLE II

| Example | Material | 50° F. Rinse | 90° F. Rinse |
|---|---|---|---|
| 7 | Stearyl trimethyl ammonium chloride | −2.0 | −1.1 |
| 8 | Palmityl trimethyl ammonium chloride | −0.9 | −2.4 |
| 9 | Palmityl trimethyl ammonium bromide | −1.0 | −1.0 |
| 10 | Ditallow dimethyl ammonium chloride | −1.0 | −0.6 |
| 11 | Myristyl trimethyl ammonium bromide | −0.8 | −0.75 |
| 12 | 75% Ditallow dimethyl ammonium methylsulfate; 25% Myristyl trimethyl ammonium bromide | +0.3 | 0 |

Appendix—Measurement of Cationic Surfactant Residue

What follows is a description of the procedure used to measure the residual amount of cationic materials found in the pouches of Examples 1–6 above.

The method described herein is an adaptation of the titration of anionic surfactants described in Reid et al., "Determination of Anionic Active Detergents by Two-Phase Titration," *Tenside* 4, 1967, pp. 292–304.

To measure the residual quaternary ammonium softeners in the pouches of Examples 1–6 after they were used in a laundering operation, the following stepwise procedure was used:

1. First, a 0.004 N solution of Hyamine 1622 was prepared. Hyamine 1622 is available from Rohm and Haas Company, Philadelphia, Pa.

2. A 0.004 N solution of reagent grade linear alkyl benzene sulfonate having an alkyl chain length of 11.8 (LAS) was prepared. This LAS solution was used in place of the sodium lauryl sulfate reagent described in the *Tenside* article already cited, page 302.

3. The residual quaternary ammonium softeners were extracted from the test pouches. This was done by cutting up the pouch and residue into small pieces, placing these pieces in a flask, and adding to the flask 250.0 milliliters of methanol and 250.0 milliliters of chloroform. A magnetic stirring bar was placed within the flask, the flask was stoppered, and the contents of the flask were stirred at room temperature for 2–4 hours by actuating the magnetic stirring bar with a magnetic stirring base.

4. A aliquot was prepared to be titrated. To do this, 10 milliliters of solution were withdrawn from the stirred flask of Step 3, the methanol and chloroform were evaporated, and the dried contents were quantitatively transferred to a 100 milliliter graduated cylinder with 20–30 milliliters of chloroform.

5. An indicator solution was prepared. A suitable indicator is described on pages 302–303 of the Reid article cited above. (Solution 8.3. g)

6. 10 milliliters of the indicator solution and 10 milliliters of distilled water were added to the graduated cylinder containing the titration aliquot.

7. The aliquot was titrated with the LAS solution until the bottom layer was pink. The number of millimeters of LAS solution used were recorded.

8. The aliquot was then titrated with the Hyamine solution until the bottom layer was gray. The amount of Hyamine solution used (ml) was recorded. A gray bottom layer is the endpoint of the titration.

9. The weight of residual quaternary ammonium softeners in the pouch was then calculated from the following formula:

V = 500 milliliters
a = 10 milliliters
MW is the average molecular weight of the two components of the original quaternary ammonium softener mixture
Q = grams of the quaternary ammonium softener
B = ml of LAS solution used
T = ml of Hyamine solution used $$Q = [B \times N_1 - T \times N_2] \frac{V \times MW}{1000a}$$

$N_1$ = Normality of LAS
$N_2$ = Normality of Hyamine.

What is claimed is:

1. A comelted, solid, granular fabric softening composition comprising:

A. 60% to 85% of a first compound having the formula:

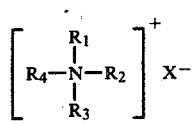

wherein $R_1$ and $R_2$ are lower alkyl moieties, $R_3$ and $R_4$ are each higher alkyl or alkenyl moieties having from about 14 to about 22 carbon atoms, and X is an anion; and B. 15% to 40% of a second compound having the formula:

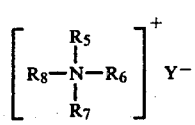

wherein $R_5$, $R_6$ and $R_7$ are each lower alkyl moieties, $R_8$ is an alkyl or alkenyl moiety having from about 10 to about 14 carbon atoms, and Y is an anion;

wherein the softening effect of said solid, granular composition is improved with, improved rinse water dispersibility.

2. The composition of claim 1, wherein said $R_5$, $R_6$ and $R_7$ moieties are separately selected from a group consisting of methyl, ethyl and propyl moieties.

3. The composition of claim 2, wherein said $R_1$ and $R_2$ moieties are separately selected from a group consisting of methyl, ethyl and propyl moieties.

4. The composition of claim 3, wherein said $R_3$ and $R_4$ moieties are alkyl moieties.

5. The composition of claim 4, wherein X and Y are anions separately selected from a group consisting of chloride, bromide, fluoride, iodide, acetate, phosphate, nitrite, methyl sulfate, ethyl sulfate and nitrate anions.

6. The composition of claim 5, wherein said $R_8$ moiety is an alkyl moiety.

7. The composition of claim 6, wherein said $R_8$ moiety is a myristyl moiety.

8. The composition of claim 7, wherein said $R_1$, $R_2$, $R_5$, $R_6$ and $R_7$ moieties are each a methyl moiety.

9. The composition of claim 8, wherein X is a methyl sulfate anion and Y is a bromide anion.

10. The composition of claim 1, further characterized as comprising about 70% to about 80% of said first compound and about 20% to about 30% of said second compound.

11. The composition of claim 10, further characterized as comprising about 75% of said first compound and about 25% of said second compound.

* * * * *